US006271816B1

(12) United States Patent
Jeong et al.

(10) Patent No.: US 6,271,816 B1
(45) Date of Patent: Aug. 7, 2001

(54) POWER SAVING CIRCUIT AND METHOD FOR DRIVING AN ACTIVE MATRIX DISPLAY

(75) Inventors: Deog-Kyoon Jeong, Seoul (KR); Gyudong Kim, Sunnyvale, CA (US)

(73) Assignee: Silicon Image, Inc., Sunnyvale, CA (US)

( * ) Notice: Subject to any disclaimer, the term of this patent is extended or adjusted under 35 U.S.C. 154(b) by 0 days.

(21) Appl. No.: 09/148,583

(22) Filed: Sep. 4, 1998

Related U.S. Application Data

(60) Provisional application No. 60/058,042, filed on Sep. 4, 1997.

(51) Int. Cl.[7] ..... G09G 3/36

(52) U.S. Cl. ..... 345/87

(58) Field of Search ..... 345/87, 88, 209, 345/210, 211, 212, 99, 100

(56) References Cited

U.S. PATENT DOCUMENTS

| | | | | |
|---|---|---|---|---|
| 4,652,872 | * | 3/1987 | Fujita | 340/781 |
| 4,864,182 | * | 9/1989 | Fujioka et al. | 315/169.3 |
| 4,888,523 | * | 12/1989 | Shoji et al. | 315/169.3 |
| 5,528,256 | | 6/1996 | Erhart et al. | 345/96 |
| 5,838,289 | * | 11/1998 | Saito et al. | 345/79 |
| 6,049,321 | * | 4/2000 | Sasaki | 345/99 |
| 6,169,532 | * | 1/2001 | Sumi et al. | 345/98 |

FOREIGN PATENT DOCUMENTS

| | | |
|---|---|---|
| 0631271 | 12/1994 | (EP) . |
| 0755044 | 1/1997 | (EP) . |
| 04355789 * | 12/1992 | (JP) . |
| 09120053 | 5/1997 | (JP) . |

* cited by examiner

*Primary Examiner*—Richard Hjerpe
*Assistant Examiner*—Ronald Laneau
(74) *Attorney, Agent, or Firm*—Fenwick & West LLP

(57) ABSTRACT

Switches and capacitors are efficiently used to passively change the voltage level on column electrodes without active driving by the column driver circuit. This significantly reduces the power needed by the column driver circuit to drive voltages of alternating polarity onto the column electrodes. In this way, significant power is saved in both the pixel inversion and the row inversion schemes. The average power savings of various of the embodiments exceeds 50% compared with a simple conventional implementation of a column driver circuit. Another aspect similarly reduces the power used by the column driver circuit in the back plane switching scheme.

20 Claims, 14 Drawing Sheets

POWER SAVING CIRCUIT AND METHOD FOR DRIVING AN ACTIVE MATRIX DISPLAY

BACKGROUND OF THE INVENTION

This application claims priority from provisional application Ser. No. 60/058,042 filed on Sep. 4, 1997, which is incorporated by reference herein in its entirety.

1. Technical Field

This invention relates to electronic circuits. More particularly, this invention relates to electronic circuits for driving active matrix (thin-film transistor) liquid crystal displays.

2. Description of Related Art

With recent progress in various aspects of active matrix (thin-film transistor) liquid crystal display (LCD) technology, the proliferation of active matrix displays has been spectacular in the past several years. Active matrix displays are used today in a great variety of electronic products, including notebook computers, and color versions of active matrix displays are now commonplace.

In an active matrix display, row and column electrodes form a matrix, and at the intersection of each row and column electrode is a display cell. The display cell typically comprises one transistor or switch. For a monochromatic display, each display cell would correspond to a single gray-scale pixel or dot of the display. For a color display, a grouping of three display cells (typically, one red, one green, and one blue) nearby each other would correspond to a single color pixel or dot of the display. For example, a color VGA display has a resolution of 480 rows and 640 columns of color pixels. Since three cells are needed for each color pixel, 640×3=1,920 column electrodes are typically present, along with 480 row electrodes. Naturally, higher resolution displays require more row and column electrodes, and displays are nowadays becoming increasingly higher in resolution.

An active matrix display is operated by applying a select voltage to a first row electrode to activate the gates of the first row of cells, and then applying in parallel appropriate analog display voltages to every one of the column electrodes to charge each cell in the first row to a desired level. Next, a select voltage is applied to a second row electrode to activate the gates of the second row of cells, and then applying in parallel appropriate analog display voltages to every one of the column electrodes to charge each cell of the second row to the desired level. And so on for the rest of the rows of the display matrix.

Column drivers (or source drivers) are very important circuits in the design of an active matrix display. The column drivers receive digital display data and control and timing signals from a display controller chip, convert the digital display data to analog display voltages, and drive the analog display voltages onto column electrodes of the display. The analog display voltages vary the shade of the color that is displayed at a particular pixel of the display.

Column drivers are typically formed upon integrated circuit chips. For example, assuming one integrated circuit chip can provide 192 column drivers, then a color VGA display would require 10 such integrated circuits to drive the 1,920 column electrodes of the display. The power consumed by these column driver chips is typically significant and typically causes a substantial power drain on batteries supplying the power in a notebook (laptop) computer. This power drain is a problem which reduces the amount of time a notebook computer may be powered by a charged battery.

LCD technology is able to display images because optical characteristics of the liquid crystal material are sensitive to voltages applied across it. However, the steady application of a near constant voltage across an LCD cell will, over time, degrade the properties and characteristics of the material in that cell. Therefore, LCDs are typically driven using techniques which alternate the polarity of the voltages applied across a cell. These voltages of "alternating polarity" may be voltages above or below a predetermined midpoint voltage (which may be non-zero).

Conventional implementations of the above described technique of applying voltages of alternating polarity typically result in large voltage transitions whenever the polarity is changed. Such large voltage transitions result in significant usage of power which is typically provided by the column driver circuits.

Display Inversion

There are several inversion schemes possible to implement the above described technique of applying voltages of alternating polarity. A first, and perhaps simplest, inversion scheme may be called "display inversion." In display inversion, every cell in the display is driven to a positive voltage (with respect to the midpoint voltage) during a first display cycle, and then every cell is driven to a negative voltage (with respect to the midpoint voltage) during a second display cycle, and continuing by alternating between the first and second display cycles.

One drawback with the display inversion scheme is that the LCD may alternately display two different images; this alternation between two images being perceived by the viewer as a flicker in the display.

Row Inversion

A second inversion scheme may be called "row inversion" or "line inversion." In row inversion, the driving voltages applied by the column drivers will alternate in polarity between successive rows of the display. Thus, a first row of pixels would be driven to positive voltages, a second adjacent row of pixels would be driven to negative voltages, and so on (alternating between positive and negative).

In addition, on the subsequent display cycle, the first row would be driven to negative voltages, the second row would be driven to positive voltages, and so on. Thus, inversion between alternating display cycles also occurs in the row inversion scheme.

A drawback with the row inversion scheme is that between successive row drive periods, the column drivers must typically alternate between driving positive and negative voltages. This alternation between positive and negative voltages results in the consumption of significant amounts of power by the column drivers. (In comparison, in the display inversion scheme, the column drivers need to oscillate between positive and negative voltages only once per display cycle, instead of once per row drive period.)

Pixel Inversion

A third inversion scheme may be called "pixel inversion" or "dot inversion." In pixel inversion, the driving voltages applied by adjacent column drivers will alternate. Thus, during a row drive period, a first column would be driven to a positive voltage, a second column (adjacent to the first) would be driven to a negative voltage, a third column (adjacent to the second) would be driven to a positive voltage, and so on.

In addition, during the row drive period for the next row, the first column would be driven to a negative voltage, the second column would be driven to a positive voltage, the third column would be driven to a negative voltage, and so on. Thus, inversion between alternating rows also occurs in the pixel inversion scheme. Finally, inversion between alternating display cycles also occurs in the pixel inversion scheme.

The pixel inversion scheme typically suffers from the same drawback as discussed above with respect to the row inversion scheme. This is because the pixel inversion scheme includes row inversion, so the pixel inversion scheme also results in a significant drain of power as the column drivers alternate polarities between row drive periods.

Back Plane Switching

For optimal performance of the display, due to characteristics of the liquid crystal material in an active matrix display, column drivers typically need to drive voltages ranging between ±6 volts with respect to the midpoint voltage. This voltage range would typically preclude the use of integrated circuits manufactured with small dimension processes because those processes typically support operation only at about 5 volts or less. Chips are less efficiently produced by larger dimension processes. However, in order to avoid needing to use larger dimension processes, a technique called back plane switching may be used.

The back plane switching technique is typically used in conjunction with row inversion. In back plane switching, a bias voltage is driven onto the back plane of the active matrix display. The back plane bias voltage is driven with an alternating current (AC) waveform that is out-of-phase with the voltages applied by the column drivers. So, when the column drivers are outputting a positive polarity voltage, the back plane bias voltage is driven to a negative polarity voltage, and vice versa.

An additional drawback to the back plane switching technique is that a substantial amount of power is used switching the polarity of the back plane bias voltage between successive row drive periods in the row inversion scheme.

U.S. Pat. No. 5,528,256 (Erhart et al.)

U.S. Pat. No. 5,528,256 (Erhart et al.) discloses a column driver integrated circuit which uses multiplexers to selectively couple each of the columns to a common node during a portion of each row drive period. During the remaining portion of each row drive period, the multiplexers selectively couple voltage drivers to the columns of the LCD pixel array. In addition, Erhart et al. discloses the option of connecting the common node to an external storage capacitor. However, the circuit disclosed in Erhart et al. is unnecessarily complicated and moreover is limited in result to an average power savings of about 50% or less compared with a simple conventional implementation of a column driver circuit.

SUMMARY OF THE INVENTION

The above described problems and drawbacks are solved by the present invention. Switches and capacitors are efficiently used to passively change the voltage level on column electrodes without active driving by the column driver circuit. This significantly reduces the power needed by the column driver circuit to drive voltages of alternating polarity onto the column electrodes. In this way, significant power is saved in both the pixel inversion and the row inversion schemes. The average power savings of various of the embodiments exceeds 50% compared with a simple conventional implementation of a column driver circuit. Another aspect similarly reduces the power used by the column driver circuit in the back plane switching scheme.

DESCRIPTION OF THE PREFERRED EMBODIMENTS

Figure 1A:
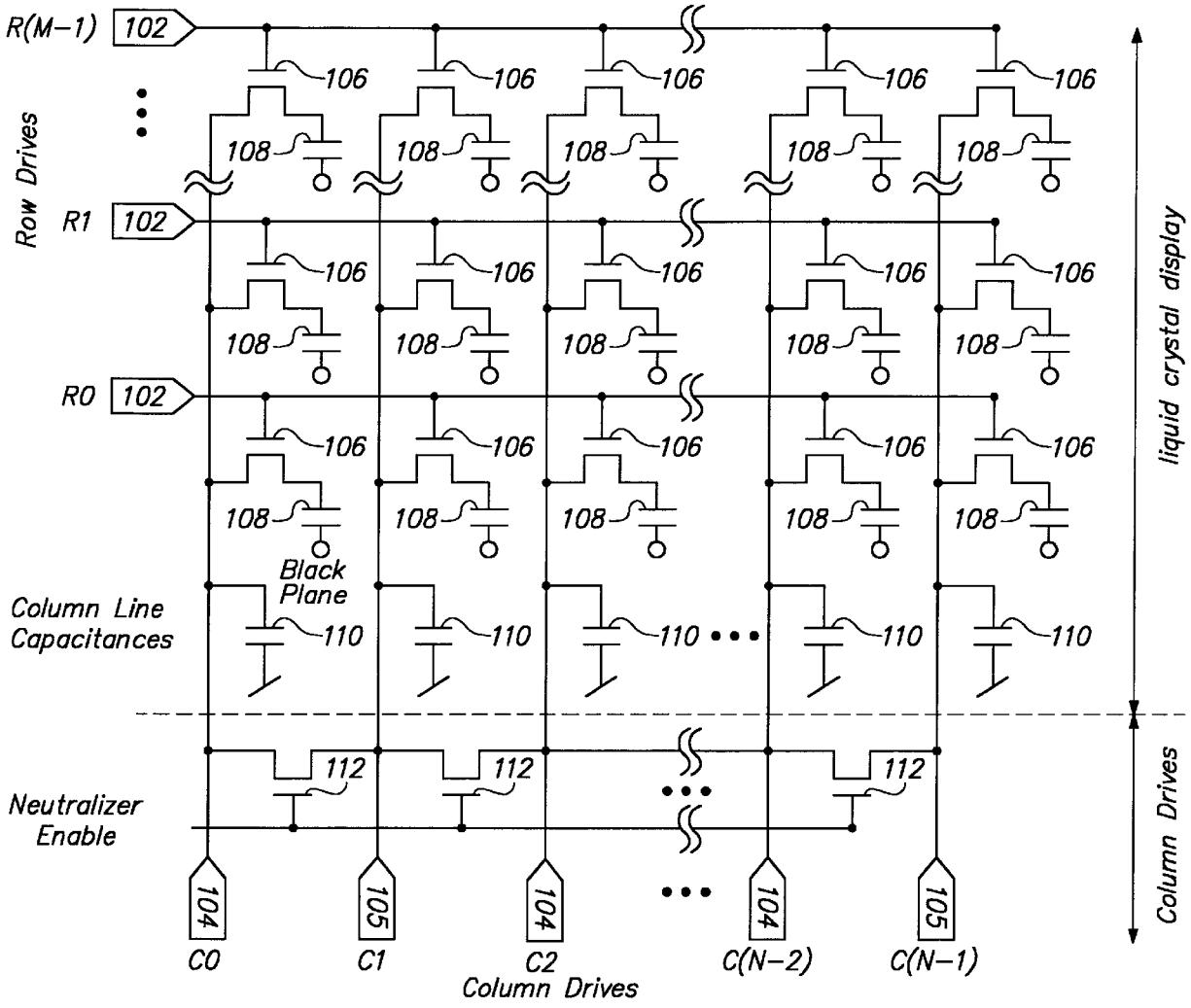
FIG. 1A is a circuit diagram of a first embodiment of the present invention.

FIG. 1A is a circuit diagram of a first embodiment of the present invention. The first embodiment of the invention includes: M row drivers 102 attached to M row lines labeled R0 to R(M−1); N/2 even 104 and N/2 odd 105 column drivers attached to N column lines labeled C0 to C(N−1); M×N display cells each comprising a transistor 106 and a capacitance 108; N column line capacitances 110; and a neutralizer enable line controlling N−1 neutralizer transistors 112. Note that the N column line capacitances 110 are not purposefully introduced into the circuit, but rather they represent the capacitances typically present in such column lines.

The circuit in FIG. 1A may be utilized to implement pixel inversion of an active matrix display while saving power over a conventional implementation of pixel inversion. As discussed above, in pixel inversion, the driving voltages applied by adjacent column drivers will alternate. Thus, during a row drive period, a first column would be driven to a positive voltage, a second column (adjacent to the first) would be driven to a negative voltage, a third column (adjacent to the second) would be driven to a positive voltage, and so on. In addition, during the row drive period for the next row, the first column would be driven to a negative voltage, the second column would be driven to a positive voltage, the third column would be driven to a negative voltage, and so on.

Figure 1B:
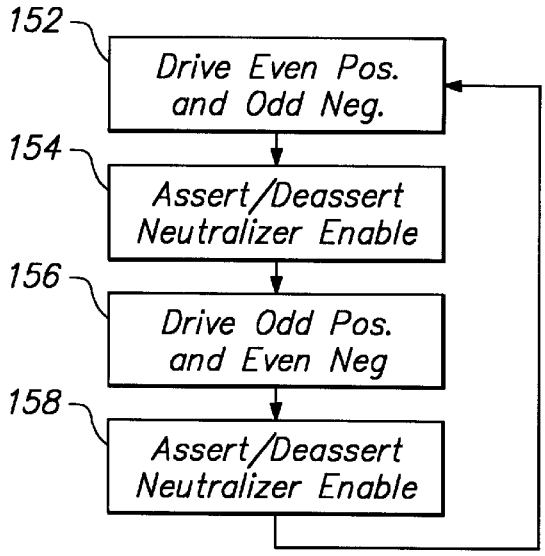
FIG. 1B is a flow chart relating to the operation of the circuit in FIG. 1A.

FIG. 1B is a flow chart relating to the operation of the circuit in FIG. 1A. During a first row drive period, in a first step 152, the even column drivers 104 drive the even column lines to relatively positive voltages with respect to a midpoint voltage, and the odd column drivers 105 drive the odd column lines to relatively negative voltages with respect to the midpoint voltage. The magnitude of the relatively positive and negative voltages depend on the intensities of the relevant pixels in the graphical image being displayed. In a second step 154, the neutralizer enable signal is asserted so that the N−1 transistors 112 are turned on. These transistors 112 act as switches which, when on, electrically shorts the N column lines together so that the voltages on the N column lines converge to an average of the voltages on the N column lines.

Similarly, during a second row drive period (immediately following the first row drive period), in a third step 156, the odd column drivers 105 drive the odd column lines to relatively positive voltages with respect to the midpoint voltage, and the even column drivers 104 drive the even column lines to relatively negative voltages with respect to the midpoint voltage. Again, the magnitude of the relatively positive and negative voltages depend on the intensities of the relevant pixels in the graphical image being displayed. In a fourth step 158, the neutralizer enable signal is asserted so that the N−1 transistors 112 are turned on. These transistors 112 act as switches which, when on, electrically shorts the N column lines together so that the voltages on the N column lines converge to an average of the voltages on the N column lines.

Following the fourth step 158, for a third row drive period (immediately following the second row drive period), the process loops back and performs the first step 152 (as applied to the third row) and so on.

Figure 1C:
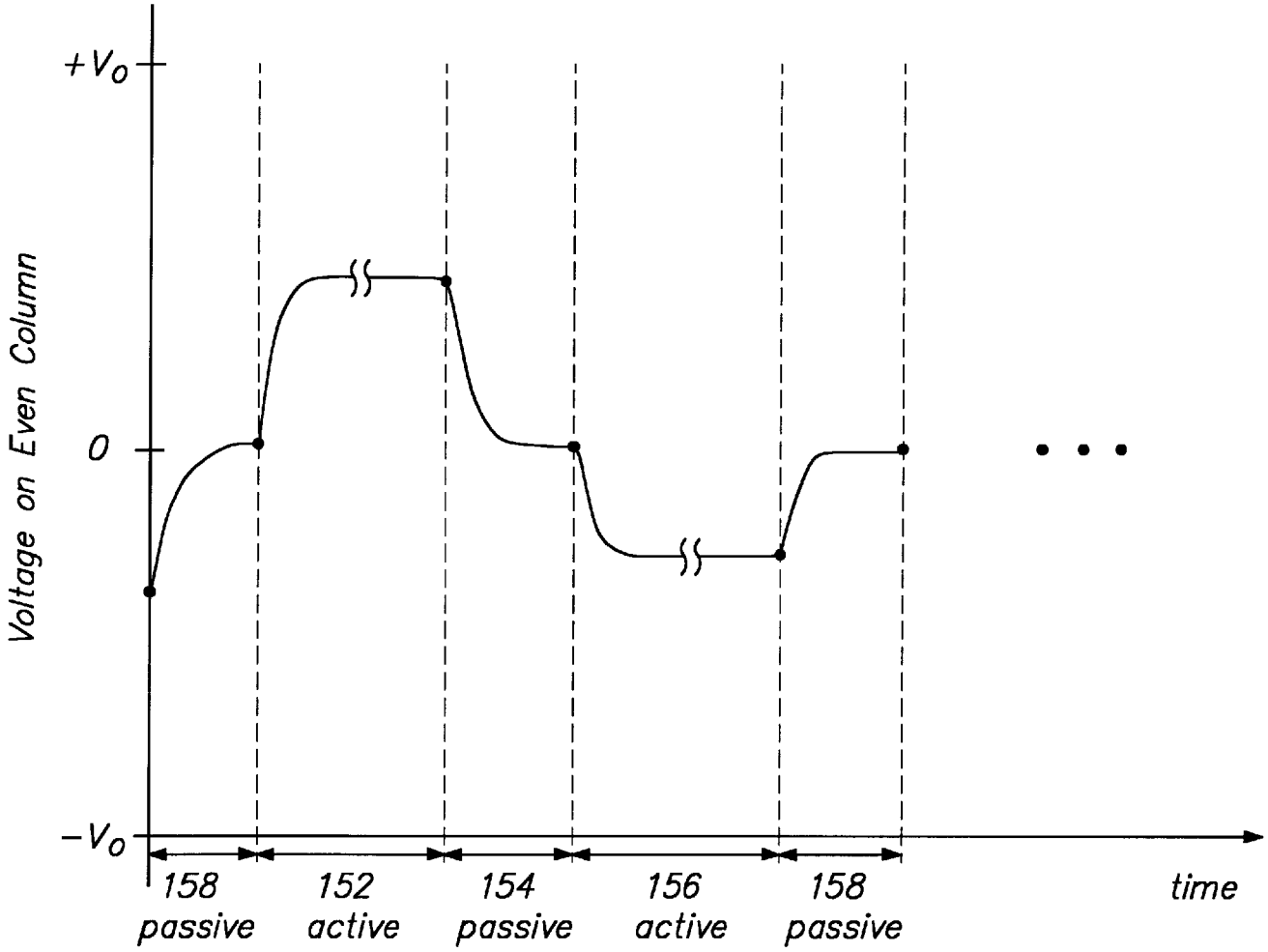
FIG. 1C is a timing diagram illustrating an example of the operation of the circuit in FIG. 1A.

FIG. 1C is a timing diagram illustrating an example of the operation of the circuit in FIG. 1A. In particular, FIG. 1C shows the voltage on an example even column line as a function of time.

As the first step 152 begins, the voltage on the example even column line is approximately the midpoint voltage, which in this particular example is shown as zero volts. As the first step 152 proceeds, the voltage on the example even column line is actively driven to a relatively positive voltage with respect to the midpoint voltage. The magnitude of this relatively positive voltage is determined by the intensity of the pixel corresponding to the selected row and the example even column. For the remainder of the first step 152, this relatively positive voltage is held.

During the second step 154, the neutralizer enable signal is asserted which causes the voltage on the example even column line to passively fall to the average voltage of the column lines. Typically, this average voltage will be approximately the midpoint voltage.

During the third step 156, the voltage on the example even column line is actively driven to a relatively negative voltage with respect to the midpoint voltage. The magnitude of this relatively negative voltage is determined by the intensity of the pixel corresponding to the next selected row and the example even column. For the remainder of the third step 156, this relatively negative voltage is held.

During the fourth step 158, the neutralizer enable signal is asserted which causes the voltage on the example even column line to passively rise to the average voltage of the column lines. Typically, this average voltage will be approximately the midpoint voltage. And soon.

As shown by FIG. 1C, approximately 50% energy savings over a conventional implementation is achieved because approximately 50% of the change in polarity between the first and third steps is achieved passively during the second and fourth steps. This approximate 50% energy savings is achieved with an efficiently designed circuit which does not require much excess space on the silicon chip of the column driver circuit.

Figure 2B:
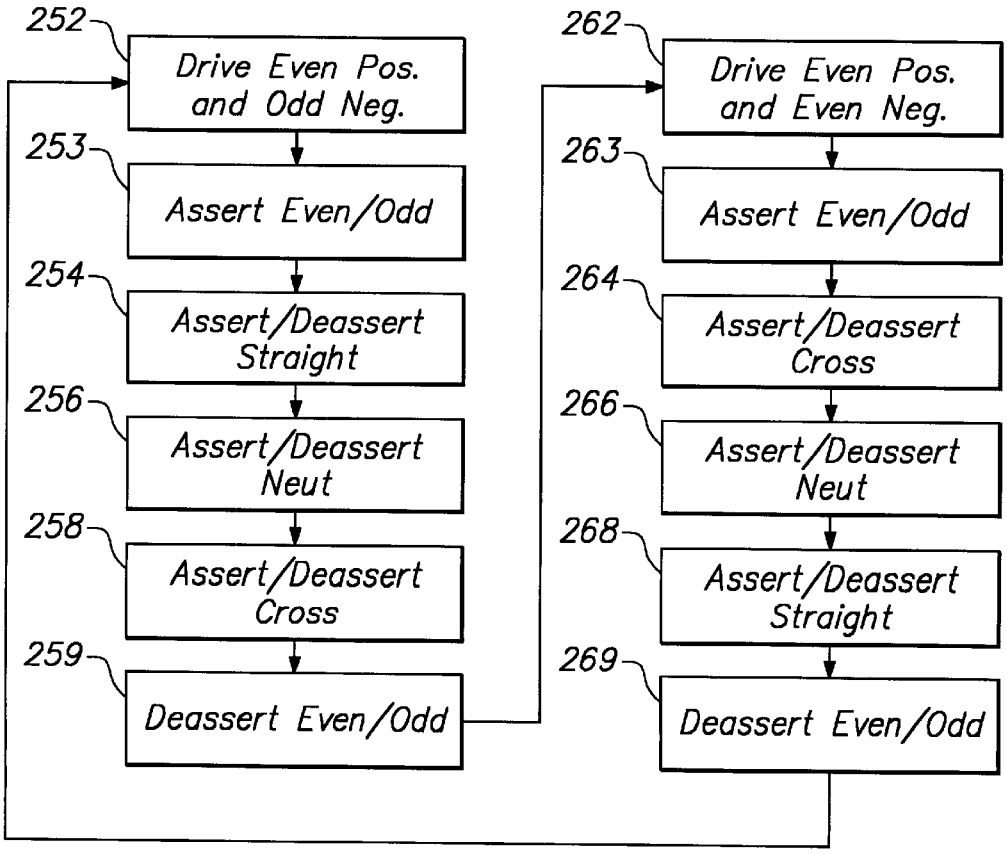
FIG. 2B is a flow chart relating to the operation of the circuit in FIG. 2A.
Figure 2A:
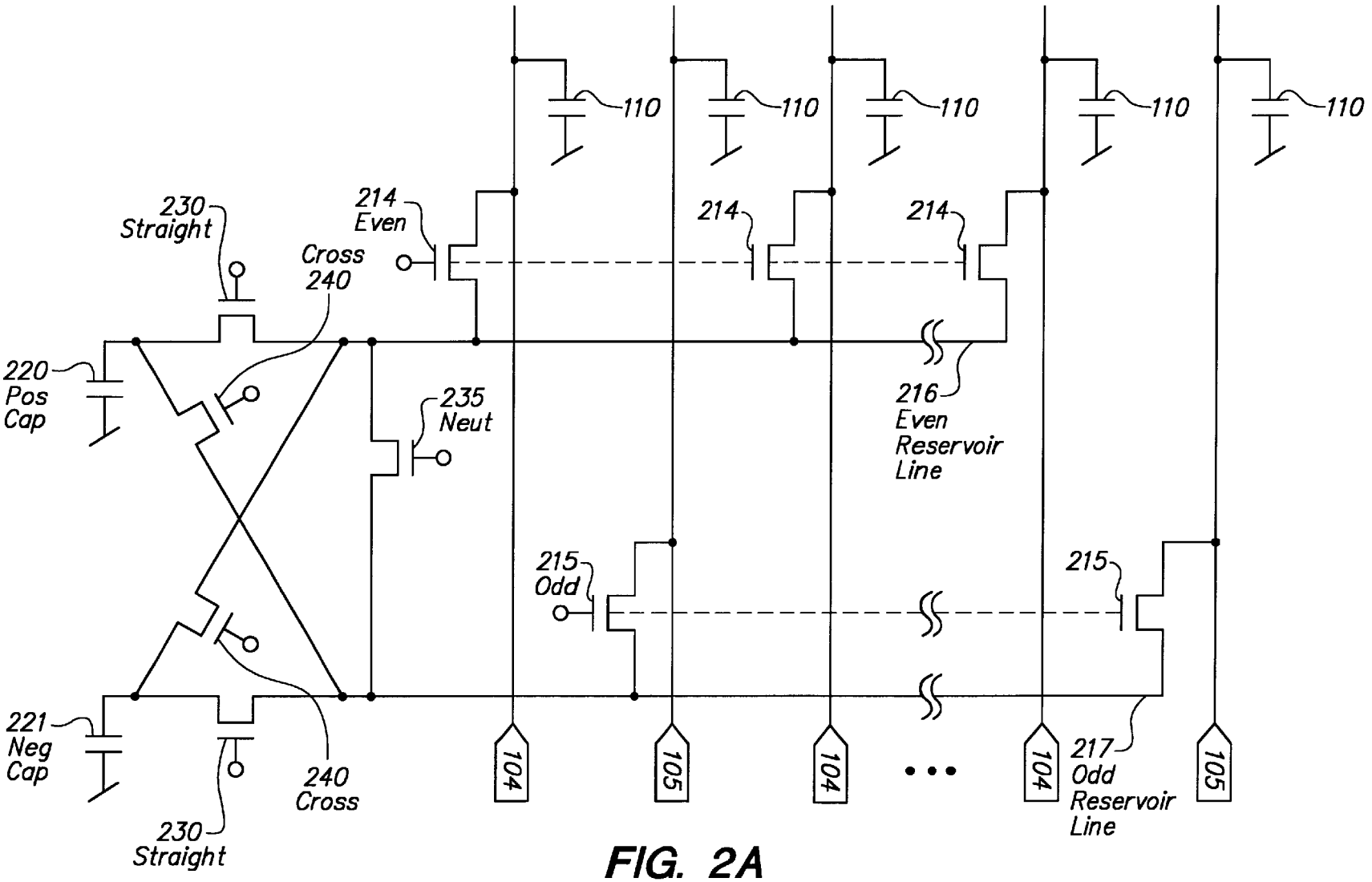
FIG. 2A is a circuit diagram of a second embodiment of the present invention.

FIG. 2A is a circuit diagram of a second embodiment of the present invention. The second embodiment of the invention includes: N/2 even 104 and N/2 odd 105 column drivers attached to N column lines labeled C0 to C(N−1); a line carrying an even coupling signal controlling N/2 even coupling transistors 214; a line carrying an odd coupling signal controlling N/2 odd coupling transistors 215; an even reservoir line 216; an odd reservoir line 217; a positive capacitor 220; a negative capacitor 221; a pair of "straight" transistors 230; a pair of "cross" transistors 240; and a "neutralize" signal controlling a "neutralize" transistor 235. Not shown in FIG. 2A is most of the circuitry in the liquid crystal display such as the M row drivers 102 and the M×N display cells. Note again that the N column line capacitances 110 are not purposefully introduced into the circuit, but rather they represent the capacitances typically present in such column lines.

The circuit in FIG. 2A may be utilized to implement pixel inversion of an active matrix display while saving power over a conventional implementation of pixel inversion. As discussed above, in pixel inversion, the driving voltages applied by adjacent column drivers will alternate. Thus, during a row drive period, a first column would be driven to a positive voltage, a second column (adjacent to the first) would be driven to a negative voltage, a third column (adjacent to the second) would be driven to a positive voltage, and so on. In addition, during the row drive period for the next row, the first column would be driven to a negative voltage, the second column would be driven to a positive voltage, the third column would be driven to a negative voltage, and so on.

FIG. 2B is a flow chart relating to the operation of the circuit in FIG. 2A. During a first row drive period, in a first step 252, the even column drivers 104 drive the even column lines to relatively positive voltages with respect to a midpoint voltage, and the odd column drivers 105 drive the odd column lines to relatively negative voltages with respect to the midpoint voltage. The magnitude of the relatively positive and negative voltages depend on the intensities of the relevant pixels in the graphical image being displayed. In a second step 253, the even coupling signal is asserted to electrically connect the even columns to the even reservoir line 216, and the odd coupling signal is asserted to electrically connect the odd column lines to the odd reservoir line 217. In a third step 254, the straight signal is asserted to turn the two straight transistors 230 on; this connects the even reservoir line 216 to the positive capacitor 220 and the odd reservoir line 217 to the negative capacitor 221. The straight signal is asserted for a period of time, then the straight signal is de-asserted. De-assertion of the straight signal disconnects the even 216 and odd 217 reservoir lines from the positive 220 and negative 221 capacitors, respectively. In a fourth step 256, the neutralize signal is asserted and then de-asserted. When the neutralize signal is asserted, the neutralize transistor 235 is turned on such that the even 216 and odd 217 reservoir lines are electrically connected together. In a fifth step 258, the cross signal is asserted to turn the two cross transistors 240 on; this connects the even reservoir line 216 to the negative capacitor 221 and the odd reservoir line 217 to the positive capacitor 220. The cross signal is asserted for a period of time, then the cross signal is de-asserted. In a sixth step 259, the even coupling signal is de-asserted to disconnect the even column lines from the even reservoir line 216, and the odd coupling signal is de-asserted to disconnect the odd column lines from the odd reservoir line 217.

Similarly, during a second row drive period (immediately following the first row drive period), in a seventh step 262, the odd column drivers 105 drive the odd column lines to relatively positive voltages with respect to a midpoint voltage, and the even column drivers 104 drive the even column lines to relatively negative voltages with respect to the midpoint voltage. The magnitude of the relatively positive and negative voltages depend on the intensities of the relevant pixels in the graphical image being displayed. In an eighth step 263, the even coupling signal is asserted to electrically connect the even columns to the even reservoir line 216, and the odd coupling signal is asserted to electrically connect the odd column lines to the odd reservoir line 217. In a ninth step 264, the cross signal is asserted to turn the two cross transistors 240 on; this connects the even reservoir line 216 to the negative capacitor 221 and the odd reservoir line 217 to the positive capacitor 220. The cross signal is asserted for a period of time, then the cross signal is de-asserted. De-assertion of the cross signal disconnects the even 216 and odd 217 reservoir lines from the negative 221 and positive 220 capacitors, respectively. In a tenth step 266, the neutralize signal is asserted and then de-asserted. When the neutralize signal is asserted, the neutralize transistor 235 is turned on such that the even 216 and odd 217 reservoir lines are electrically connected together. In an eleventh step 268, the straight signal is asserted to turn the two straight transistors 230 on; this connects the even reservoir line 216 to the positive capacitor 220 and the odd reservoir line 217 to the negative capacitor 221. The straight signal is asserted for a period of time, then the straight signal is de-asserted. Finally, in a twelfth step 269, the even coupling signal is de-asserted to disconnect the even column lines from the even reservoir line 216, and the odd coupling signal is de-asserted to disconnect the odd column lines from the odd reservoir line 217.

Following the twelfth step 269, for a third row drive period (immediately following the second row drive period), the process loops back and performs the first step 252 (as applied to the third row) and so on.

Figure 2C:
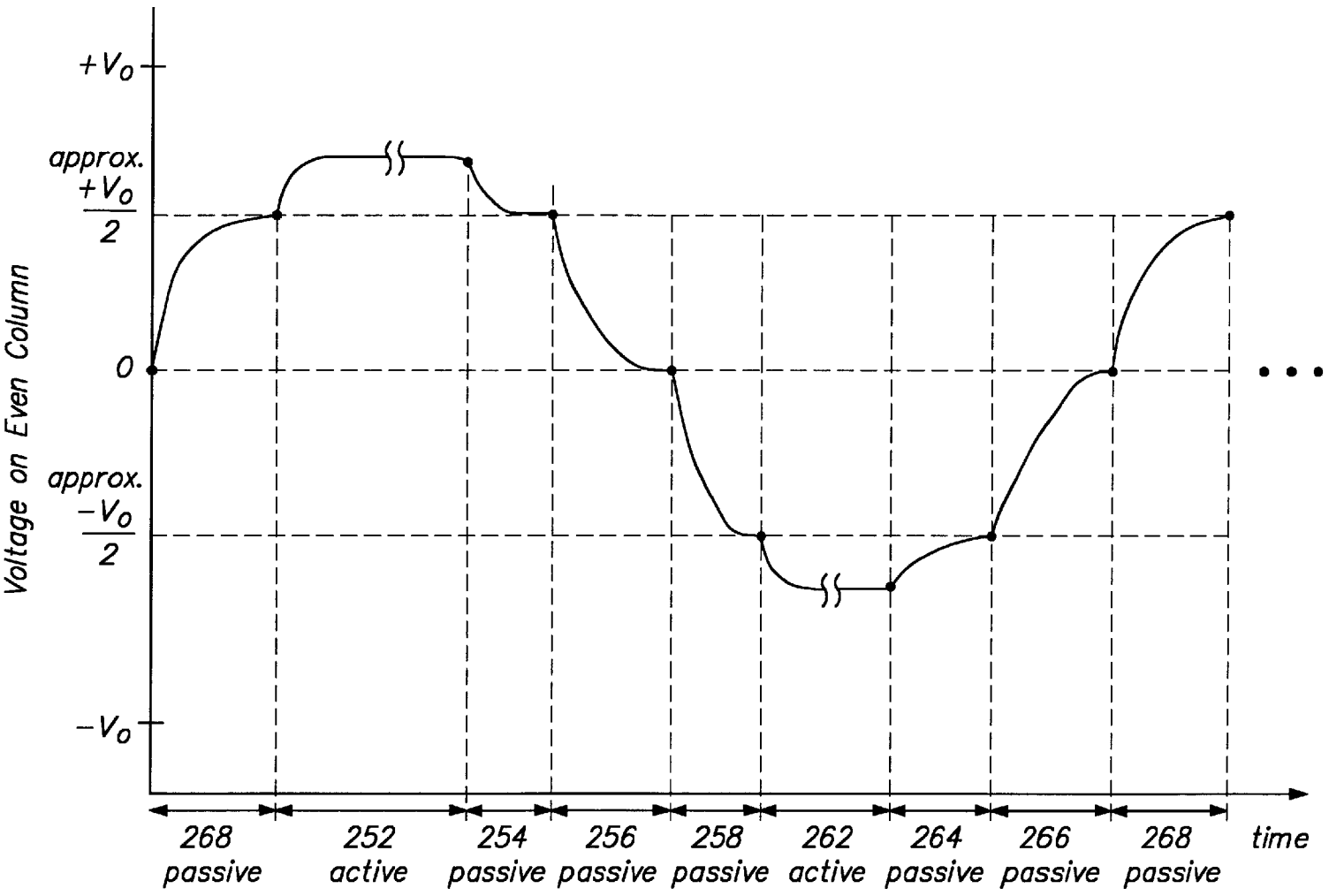
FIG. 2C is a timing diagram illustrating an example of the operation of the circuit in FIG. 2A.

FIG. 2C is a timing diagram illustrating an example of the operation of the circuit in FIG. 2A. In particular, FIG. 2C shows the voltage on an example even column line as a function of time.

As the first step 252 begins at the start of a first row drive period, the voltage on the example even column line is approximately halfway (designated Vo/2 in this particular example) between the midpoint voltage (zero volts in this particular example) and the maximum positive voltage (designated Vo in this particular example). As the first step 252 proceeds, the voltage on the example even column line is actively driven to a relatively positive voltage with respect to the midpoint voltage. The magnitude of this relatively positive voltage is determined by the intensity of the pixel corresponding to the selected row and the example even column. This relatively positive voltage may be below or above Vo/2; as shown, it is above Vo/2. For the remainder of the first step 252, this relatively positive voltage is held.

Between the first 252 and third 254 steps, the second step 253 occurs. During the second step 253, the example even column is connected to the even reservoir line 216.

During the third step 254, the straight signal is asserted which causes the voltage on the example even column line to passively change to a positive voltage near the positive voltage of the positive capacitor 220. The positive voltage of the positive capacitor 220 will be approximately Vo/2 since this would typically be the average positive polarity voltage driven by the column drivers.

During the fourth step 256, the neutralize signal is asserted and then de-asserted. While the neutralize signal is asserted, the voltage on the example even column passively drops from near Vo/2 to near the midpoint voltage (zero in this particular example).

During the fifth step 258, the cross signal is asserted and then de-asserted. While the cross signal is asserted, the voltage on the example even column line passively drops from near the midpoint voltage to near −Vo/2. This drop occurs because the negative voltage of the negative capacitor 221 is approximately −Vo/2 since this would typically be the average negative polarity voltages driven by the column drivers.

Then, during the sixth step 259, the example even column line is disconnected from the even reservoir line 216.

After the sixth step 259, the process in FIG. 2B continues into a second row drive period with a seventh step 262. During the seventh step 262, the voltage on the example even column line is actively driven to a relatively negative voltage with respect to the midpoint voltage. The magnitude of this relatively negative voltage is determined by the intensity of the pixel corresponding to the next selected row and the example even column. This relatively negative voltage may be below or above −Vo/2; as shown, it is below −Vo/2. For the remainder of the seventh step 262, this relatively negative voltage is held.

Between the seventh 262 and ninth 264 steps, the eighth step 263 occurs. During the eighth step 263, the example even column is connected to the even reservoir line 216.

During the ninth step 264, the cross signal is asserted which causes the voltage on the example even column line to passively change to a negative voltage near the negative voltage of the negative capacitor 221. The negative voltage of the negative capacitor 221 will be approximately −Vo/2 since this would typically be the average negative polarity voltage driven by the column drivers.

During the tenth step 266, the neutralize signal is asserted and then de-asserted. While the neutralize signal is asserted, the voltage on the example even column passively rises from near −Vo/2 to near the midpoint voltage (zero in this particular example).

During the eleventh step 268, the straight signal is asserted and then de-asserted. While the straight signal is asserted, the voltage on the example even column line passively rises from near the midpoint voltage to near Vo/2. This rise occurs because the positive voltage of the positive capacitor 220 is approximately Vo/2 since this would typically be the average positive polarity voltages driven by the column drivers.

Finally, during the twelfth step 269, the example even column line is disconnected from the even reservoir line 216.

After the twelfth step 269, the process loops back for a third row drive period and continues with the first step 252.

As shown by FIG. 1C, approximately 75% energy savings over a conventional implementation is achieved because approximately 75% of the change in polarity between the first and third steps is achieved passively during the second and fourth steps. This approximate 75% energy savings is achieved with an efficiently designed circuit which does not require much excess space on the silicon chip of the column driver circuit.

Figure 2D:
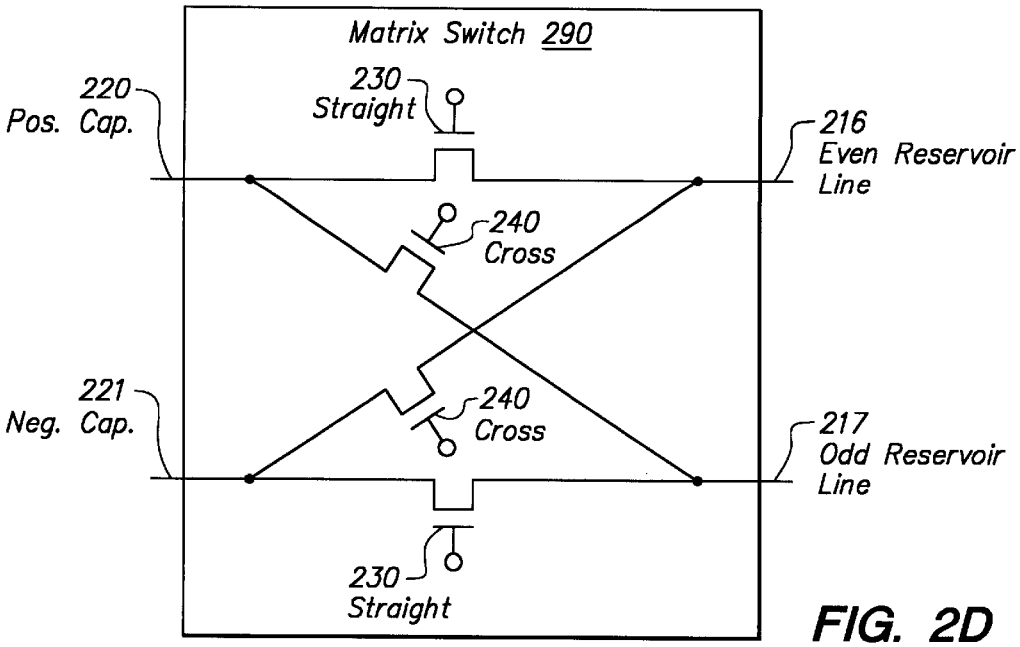
FIG. 2D is a circuit diagram of a matrix switch utilized in FIG. 2A.

FIG. 2D is a circuit diagram of a matrix switch 290 utilized in FIG. 2A. The matrix switch 290 comprises the pair of straight transistors 230 and the pair of cross transistors 240. The matrix switch 290 will be used as a building block in subsequent embodiments.

Figure 2E:
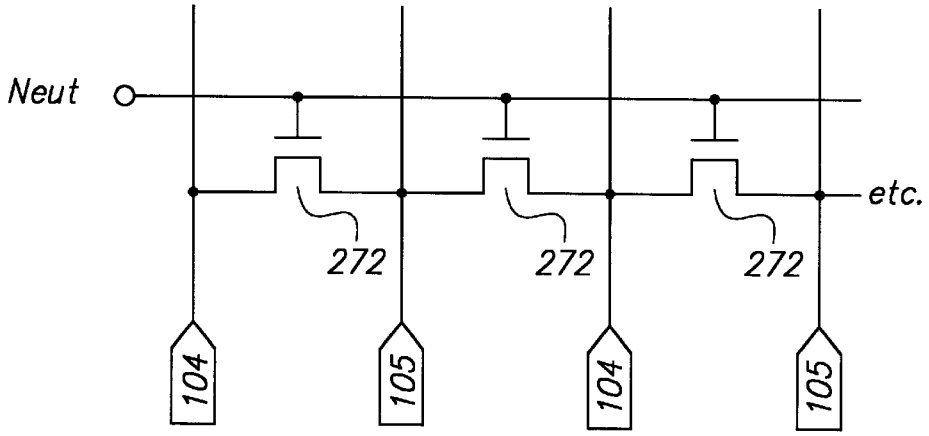
FIG. 2E is a circuit diagram of an alternative embodiment for implementing a "Neutralize" portion of the circuit in FIG. 2A.

FIG. 2E is a circuit diagram of an alternative embodiment for implementing a "Neuralize" portion of the circuit in FIG. 2A. In this alternative embodiment, the neutralize transistor 235 is replaced with N−1 transistors 272. When the neutralize signal is asserted, these N−1 transistors 272 electrically connect the (even and odd) column lines together.

Figure 2F:
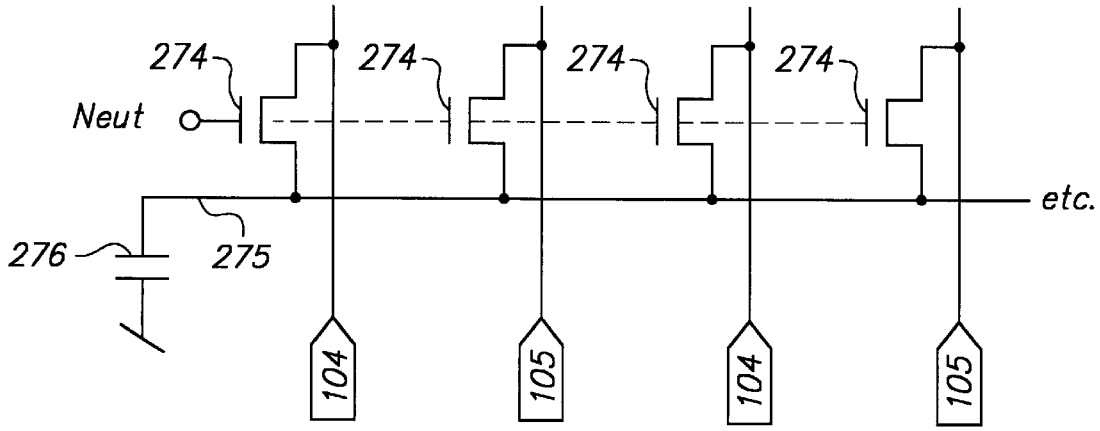
FIG. 2F is a circuit diagram of a second alternative embodiment for implementing the "Neutralize" portion of the circuit in FIG. 2A.

FIG. 2F is a circuit diagram of a second alternative embodiment for implementing the "Neutralize" portion of the circuit in FIG. 2A. In this second alternative embodiment, the neutralize transistor 235 is replaced with N transistors 274 and a line 275 to a grounded capacitor 276. When the neutralize signal is asserted, these N transistors 274 electrically connect the (even and odd) column lines to the line 275.

Figure 2G:
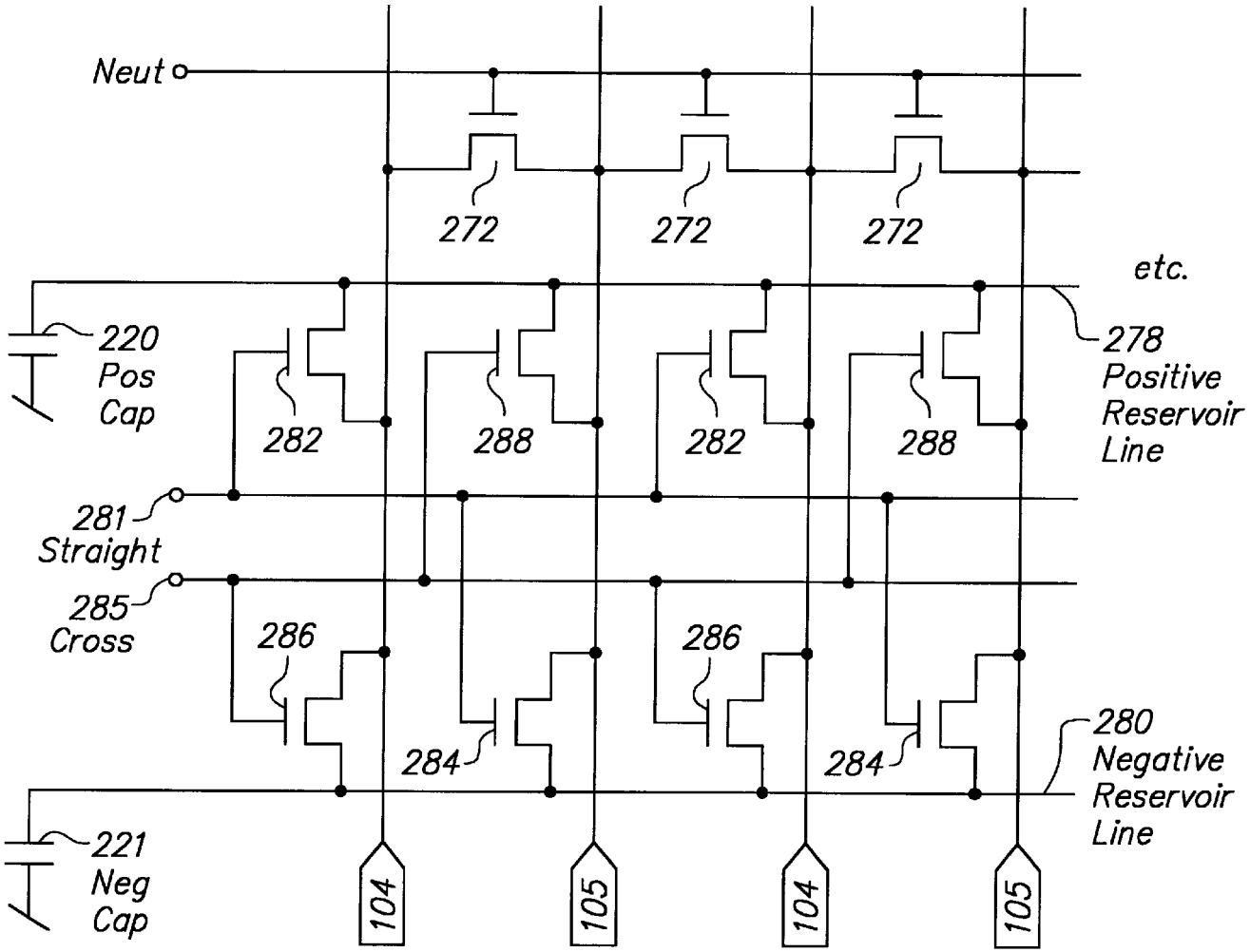
FIG. 2G is a circuit diagram of an alternative embodiment for implementing "Straight" and "Cross" portions of the circuit in FIG. 2A.

FIG. 2G is a circuit diagram of an alternative embodiment for implementing "Straight" and "Cross" portions of the circuit in FIG. 2A. This alternative embodiment replaces the matrix switch 290 (comprising the straight 230 and cross 240 transistors) and the even 216 and odd 217 reservoir lines. This alternative embodiment replaces them with a positive reservoir line 278, a negative reservoir line 280, a straight signal line 281, N/2 straight-even transistors 282, N/2 straight-odd transistors 284, a cross signal line 285, N/2 cross-even transistors 286, and N/2 cross-odd transistors 288. The positive reservoir line 278 is connected to the positive capacitor 220, and the negative reservoir line 280 is connected to the negative capacitor 221.

When the straight signal is asserted on the straight signal line 281, the straight-even transistors 282 connect the even column lines to the positive reservoir line 278, and the straight-odd transistors 284 connect the odd column lines to the negative reservoir line 280. On the other hand, when the cross signal is asserted on the cross signal line 285, the cross-even transistors 286 connect the even column lines to the negative reservoir line 280, and the cross-odd transistors 288 connect the odd column lines to the positive reservoir line 278.

The alternative embodiment in FIG. 2G may be used in conjunction with any of the above three embodiments of the neutralize portion of the circuit. FIG. 2G is shown as incorporating the embodiment of the neutralize portion in FIG. 2E. However, the embodiment in FIG. 2G will also work with the embodiment of the neutralize portion in FIG. 2F, or the embodiment of the neutralize portion in FIG. 2A.

Figure 3B:
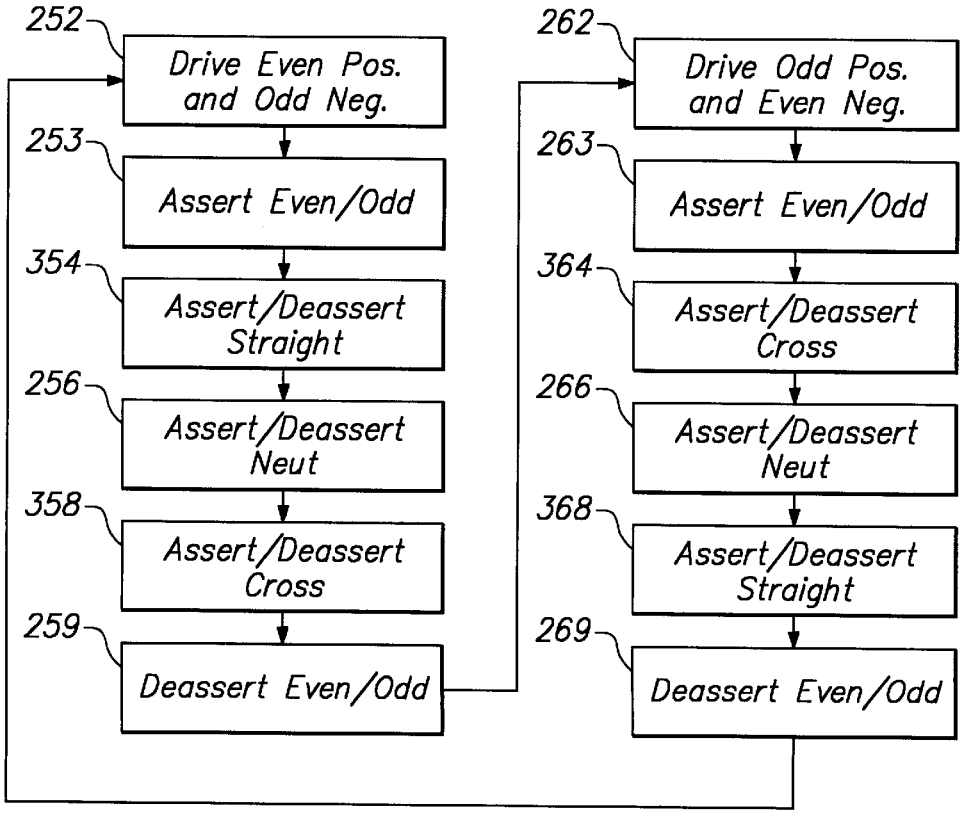
FIG. 3B is a flow chart relating to the operation of the circuit in FIG. 3A.
Figure 3A:
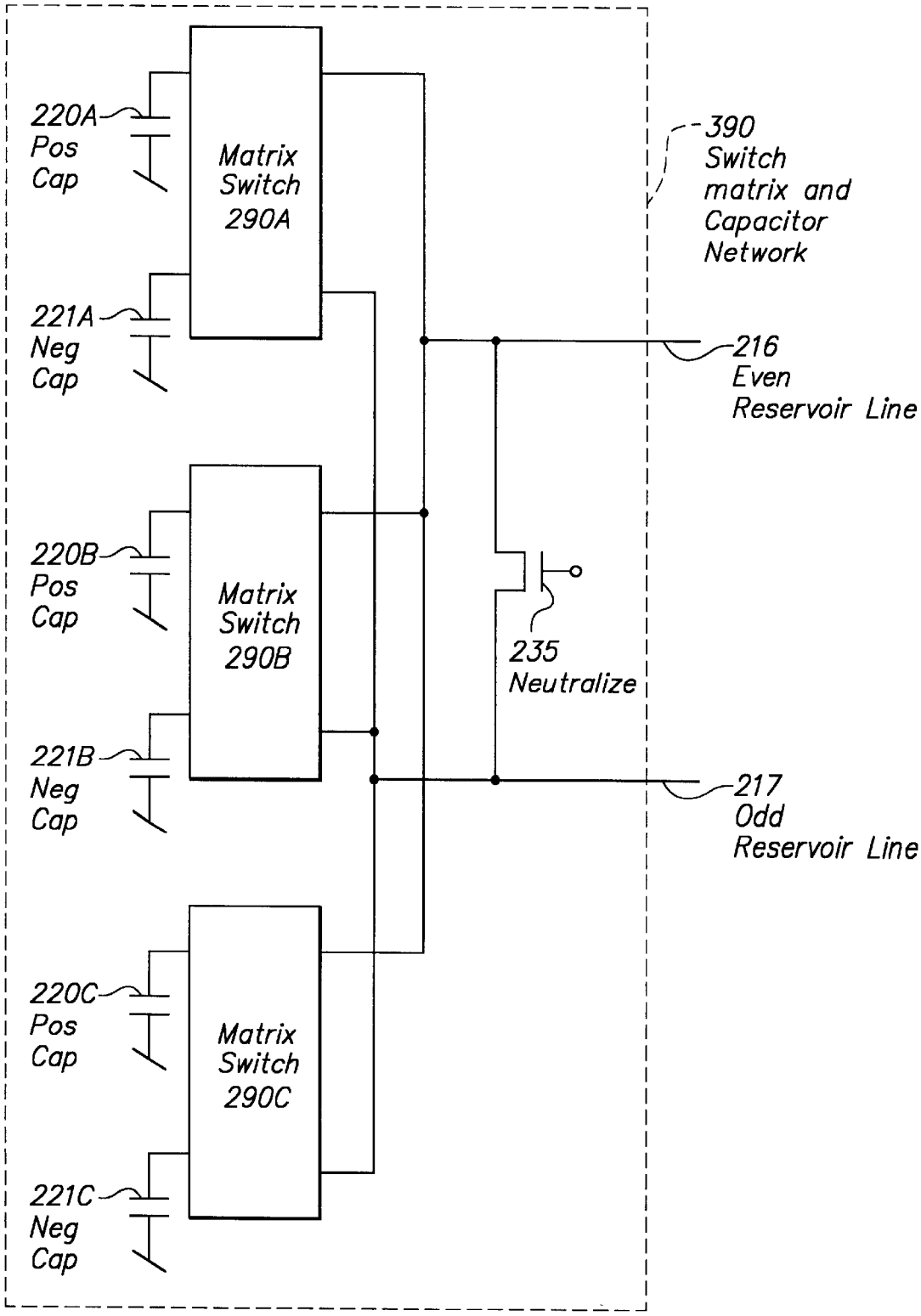
FIG. 3A is a circuit diagram of a third embodiment of the present invention.

FIG. 3A is a circuit diagram of a third embodiment of the present invention. This embodiment replaces the single positive capacitor 220, the single negative capacitor 221, and, the single matrix switch 290 in FIG. 2A with a switch matrix and capacitor network 390 comprising multiple positive capacitors 220, multiple negative capacitors 221, and multiple matrix switches 290. In the particular example shown in FIG. 3A the switch matrix and capacitor network 390 has three (A, B, and C) each, but this invention contemplates that any number may be used, such as two, four, five, and so on.

In the particular example shown in FIG. 3A, the positive voltage on the first positive capacitor 220A is approximately at Vo/2, the positive voltage on the second positive capacitor 220B is somewhat lower than that of the first positive capacitor 220A, and the positive voltage on the third positive capacitor 220C is somewhat lower than that of the second positive capacitor 220B. Similarly, the negative voltage on the first negative capacitor 221A is approximately at −Vo/2, the negative voltage on the second negative capacitor 221B is somewhat lower than that of the first negative capacitor 221A, and the negative voltage on the third negative capacitor 221C is somewhat lower than that of the second negative capacitor 221B.

FIG. 3B is a flow chart relating to the operation of the circuit in FIG. 3A. The flow chart of FIG. 3B is similar to the flow chart of FIG. 2B, except that the third 254, fifth 258, ninth 264, and eleventh 268 steps are replaced by a first process 354, a second process 358, a third process 364, and a fourth process 368 respectively.

Figure 3C:
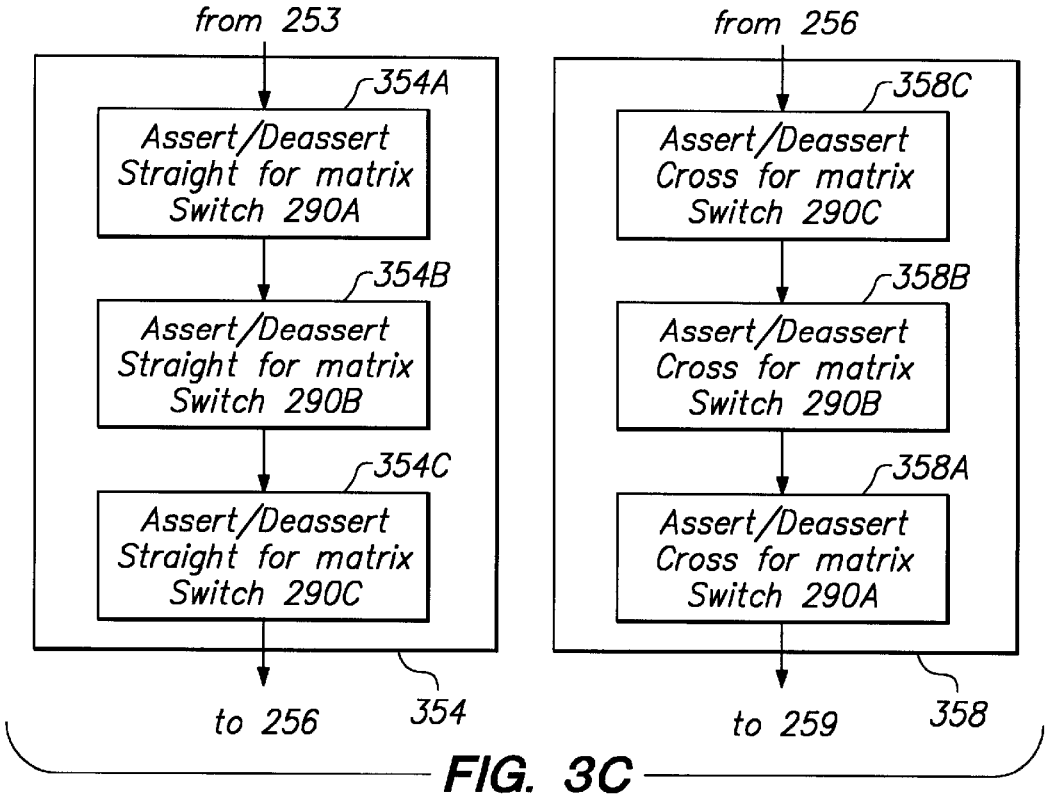
FIG. 3C includes two flow charts expanding upon respectively the first 354 and second 358 processes in the flow chart in FIG. 3B.

FIG. 3C includes two flow charts expanding upon respectively the first 354 and second 358 processes in the flow chart in FIG. 3B.

In the first process 354, in a first step 354A, the straight signal for a first matrix switch 290A is asserted and then de-asserted. In a second step 354B, the straight signal for a second matrix switch 290B is asserted and then de-asserted. In the third step 354C, the straight signal for a third matrix switch 290C is asserted and then de-asserted.

In the second process 358, in a first step 358C, the cross signal for the third matrix switch 290C is asserted and then de-asserted. In a second step 358B, the cross signal for the second matrix switch 290B is asserted and then de-asserted. In the third step 358A, the cross signal for the first matrix switch 290A is asserted and then de-asserted.

Figure 3D:
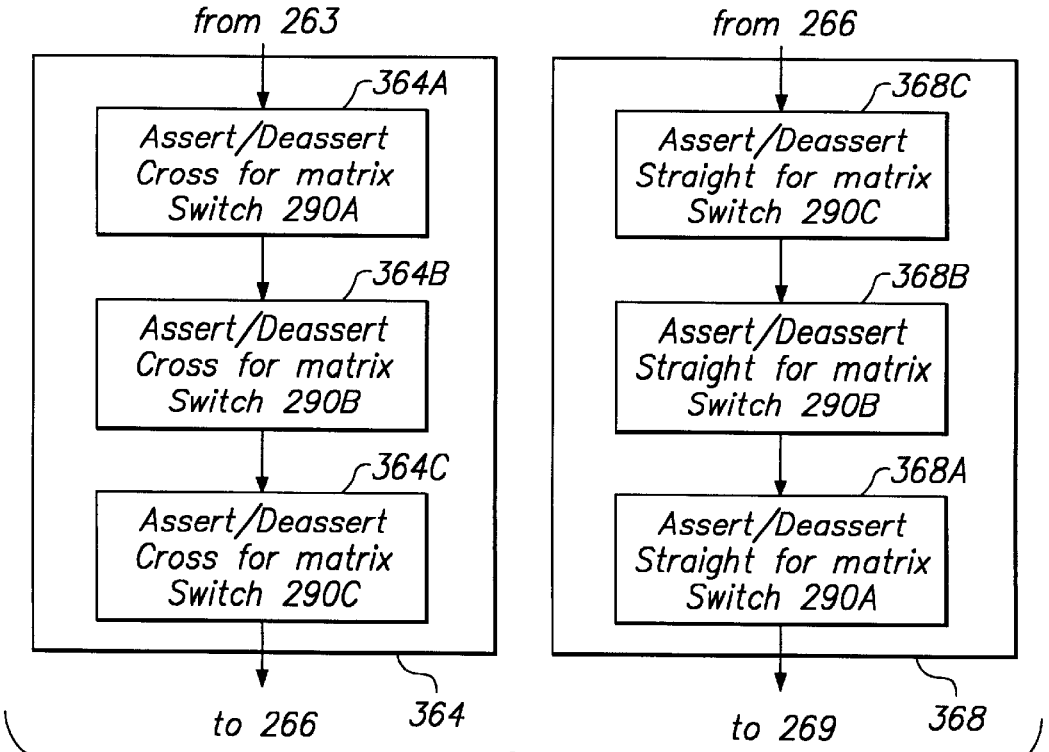
FIG. 3D includes two flow charts expanding upon respectively the third 364 and the fourth 368 processes in the flow chart in FIG. 3B.

FIG. 3D includes two flow charts expanding upon respectively the third 364 and the fourth 368 processes in the flow chart in FIG. 3B.

In the third process 364, in a first step 364A, the cross signal for a first matrix switch 290A is asserted and then de-asserted. In a second step 364B, the cross signal for a second matrix switch 290B is asserted and then de-asserted. In the third step 364C, the cross signal for a third matrix switch 290C is asserted and then de-asserted.

In the fourth process 368, in a first step 368C, the straight signal for the third matrix switch 290C is asserted and then de-asserted. In a second step 368B, the straight signal for the second matrix switch 290B is asserted and then de-asserted. In the third step 368A, the straight signal for the first matrix switch 290A is asserted and then de-asserted.

Figure 3E:
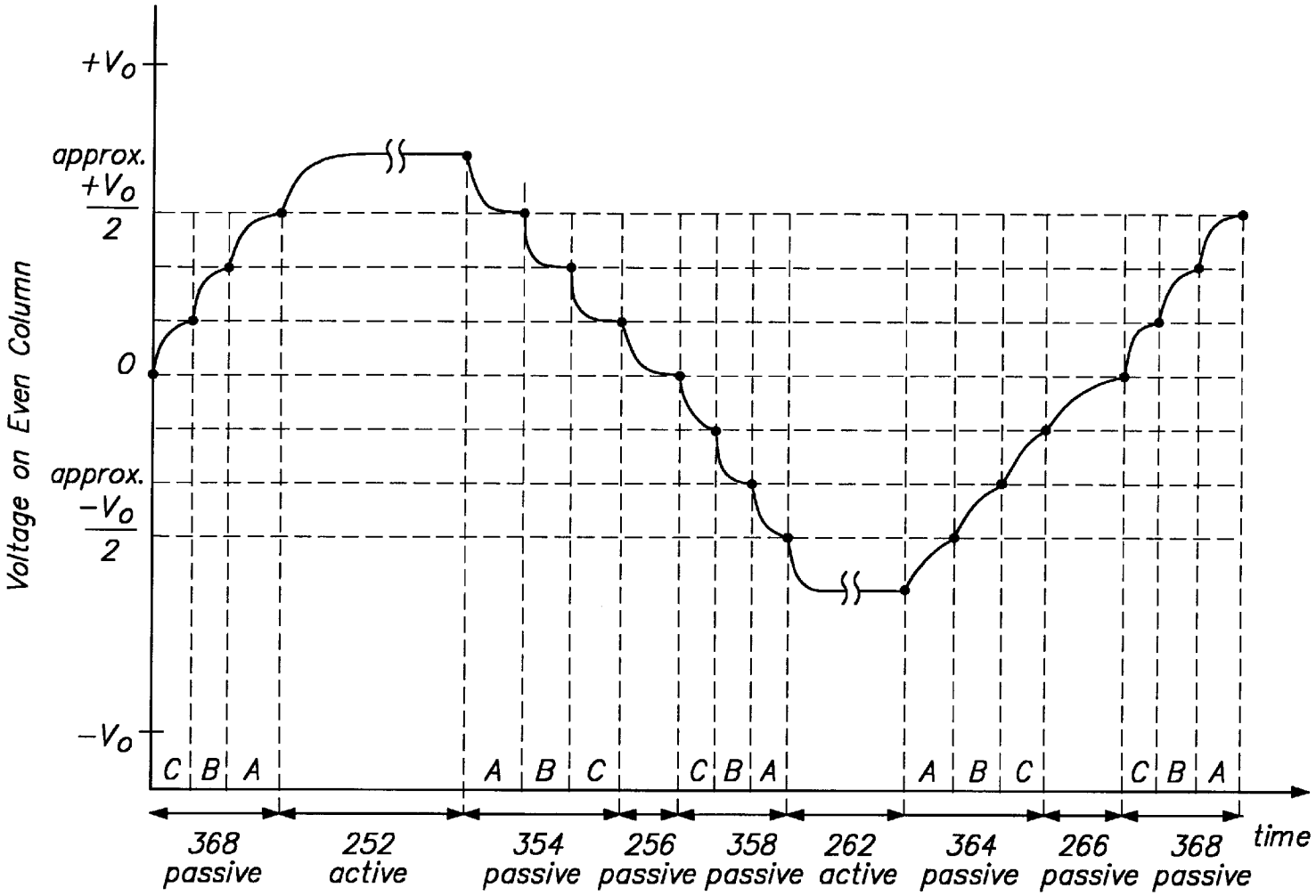
FIG. 3E is a timing diagram illustrating an example of the operation of the circuit in FIG. 3A.

FIG. 3E is a timing diagram illustrating an example of the operation of the circuit in FIG. 3A. The timing diagram in FIG. 3E is similar to the timing diagram in FIG. 2C, except that the passive voltage changes due to steps 254, 258, 264, and 268 are replaced with the passive voltage changes due to steps 354A-C, 358C-A, 364A-C, and 368C-A, respectively. Furthermore, the passive voltage change due to steps 356 and 366 are smaller than the passive voltage changes due to steps 256 and 266.

A further advantage of the circuit in FIG. 3A, as shown by the timing diagram in FIG. 3E, is that more efficient charge control is achieved, which may result in further power usage reduction.

Figure 4A:
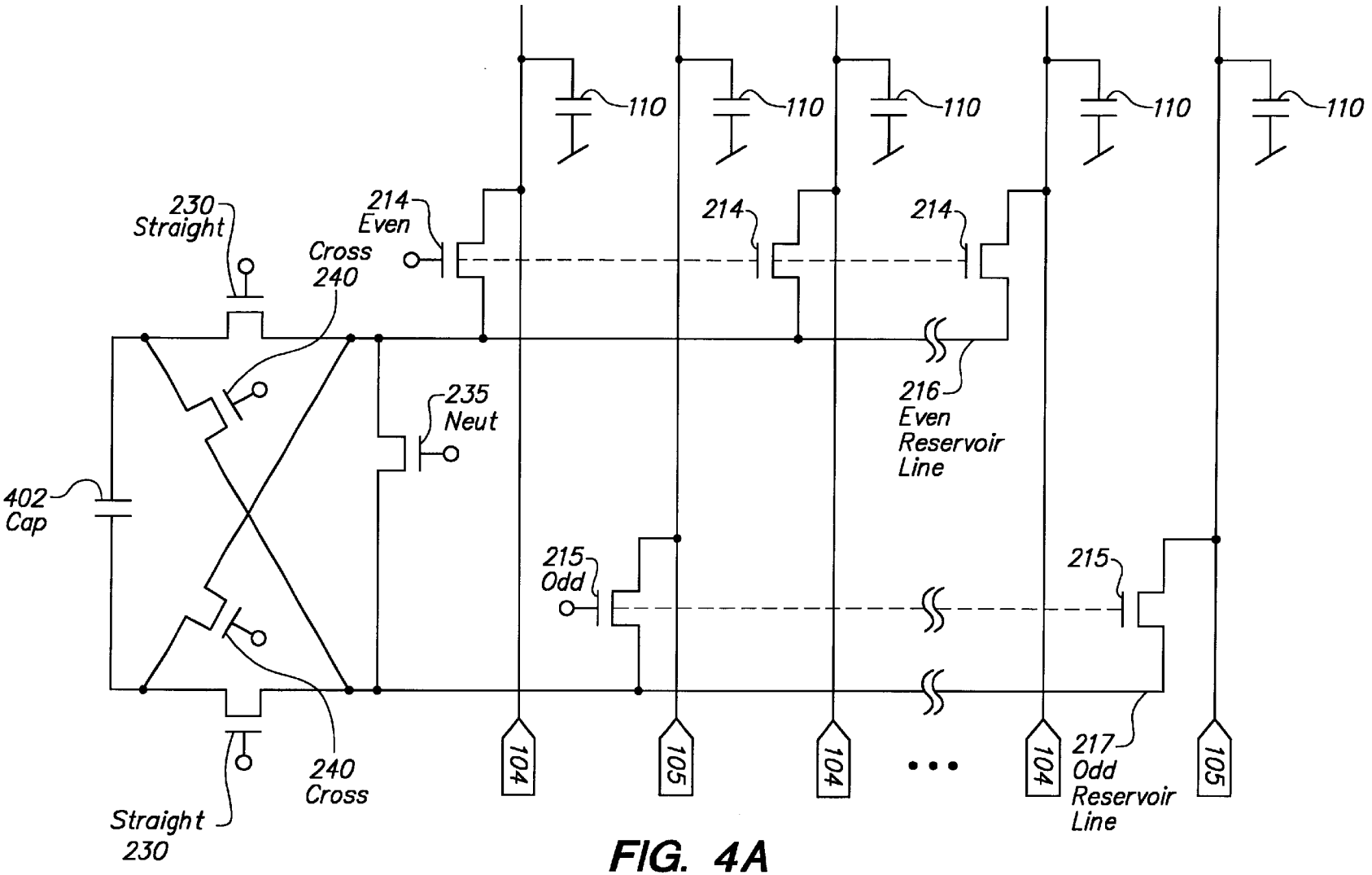
FIG. 4A is a circuit diagram of a fourth embodiment of the present invention.

FIG. 4A is a circuit diagram of a fourth embodiment of the present invention. The circuit in FIG. 4A is similar to the circuit of FIG. 2A, except that the positive 220 and negative 221 capacitors are replaced by a singular capacitor 402.

Figure 4B:
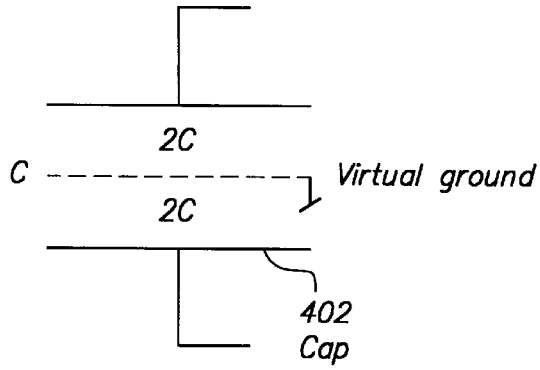
FIG. 4B is a circuit diagram expanding upon the capacitor 402 in FIG. 4A.

FIG. 4B is a circuit diagram expanding upon the singular capacitor 402 in FIG. 4A. FIG. 4B shows that the singular capacitor 402 which has a capacitance of C can be thought of as two capacitors, each with capacitance of 2C and each connected to a virtual ground. By using such a singular capacitor 402, the number of external capacitors is halved, while the power reduction performance is improved.

Figure 5:
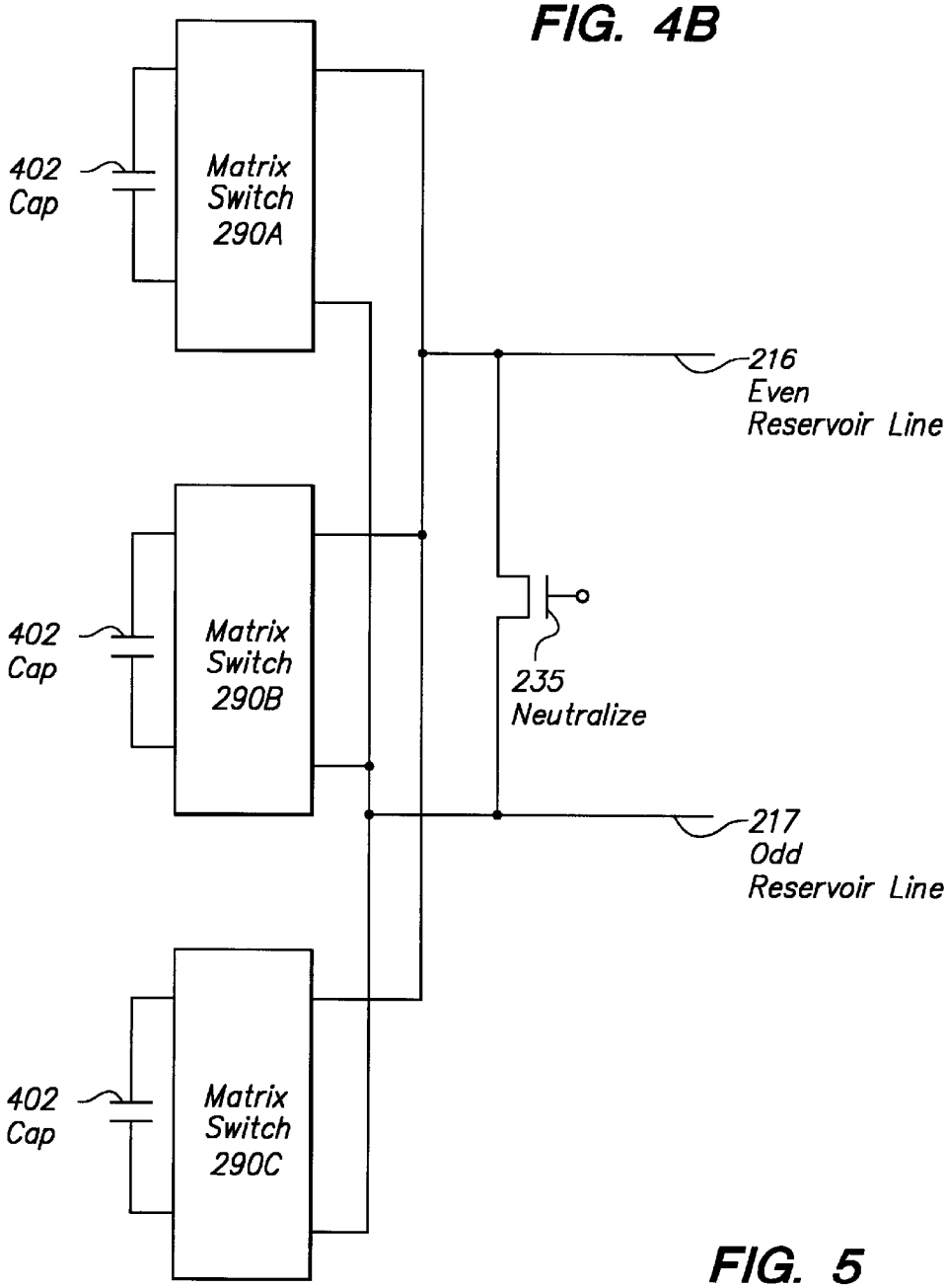
FIG. 5 is a circuit diagram of a fifth embodiment of the present invention.

FIG. 5 is a circuit diagram of a fifth embodiment of the present invention. The circuit in FIG. 5 is similar to the circuit in FIG. 3A, except that the multiple positive 220 and multiple negative 221 capacitors is replaced with multiple singular capacitors 402. By using such multiple singular capacitors 402, the number of external capacitors is halved, while the power reduction performance is improved.

Figure 6:
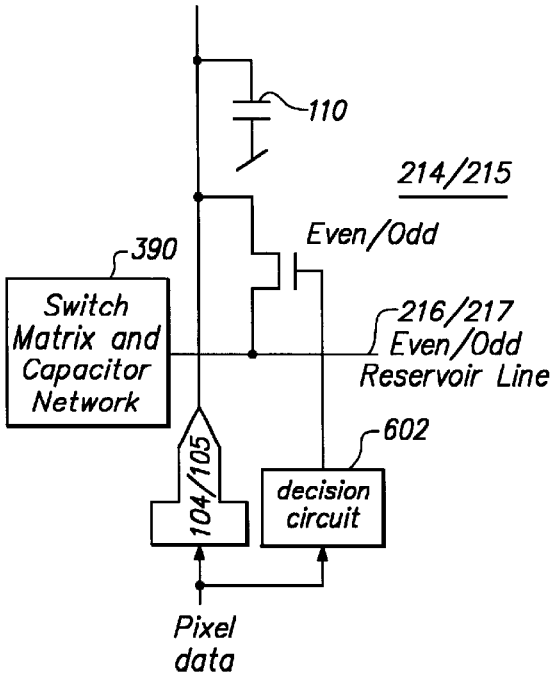
FIG. 6 is a circuit diagram of a sixth embodiment of the present invention.

FIG. 6 is a circuit diagram of a sixth embodiment of the present invention. The circuit in FIG. 6 adds N decision circuits 602 to the circuit shown in FIG. 2A. Each of the N decision circuits 602 receives pixel data for a particular column and uses previously received pixel data to decide whether and when to assert (even or odd) the neutralizer signal (214 or 215) in order to connect the particular column to its corresponding (even or odd) reservoir line (216 or 217). Note that the circuit in FIG. 6 is shown in conjunction with a switch matrix and capacitor network 390, but it may also be used in conjunction with single positive 220 and single negative 221 capacitors as shown in FIG. 2A or FIG. 2G. By utilizing previously received pixel data, the charge storing may be made more efficient.

Figure 7:
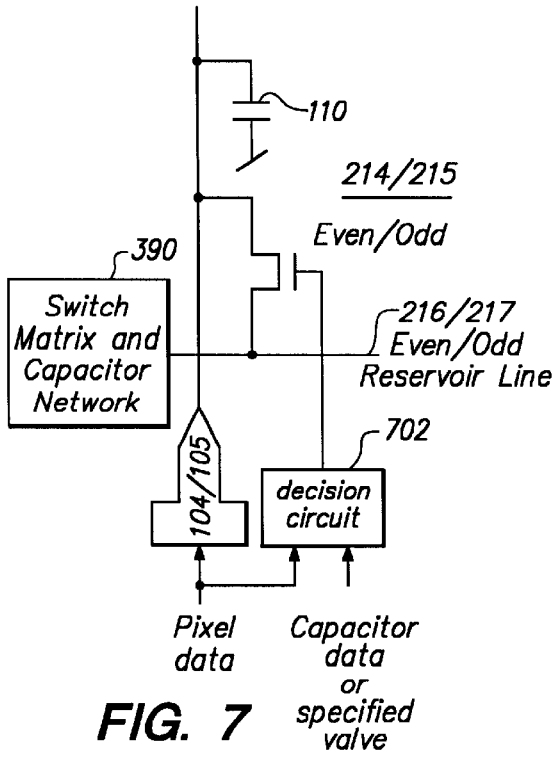
FIG. 7 is a circuit diagram of a seventh embodiment of the present invention.

FIG. 7 is a circuit diagram of a seventh embodiment of the present invention. The circuit in FIG. 7 is similar to the circuit in FIG. 6, except that FIG. 7 includes a different decision circuit 702 which not only receives pixel data, but also receives capacitor data or a specified value. The capacitor data may include the voltage level of the one or more of the capacitors in the capacitor network. By utilizing this additional information, the charge storing may be made even more efficient.

Figure 8:
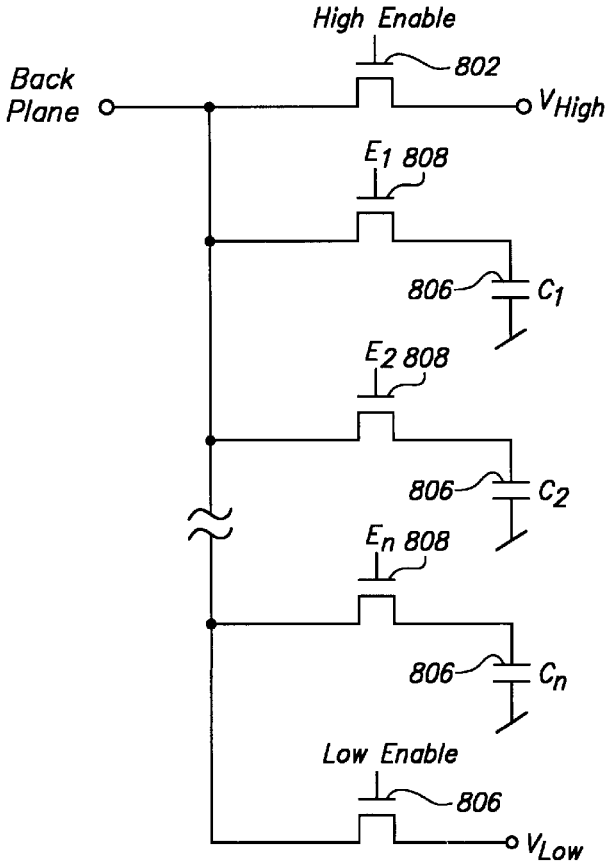
FIG. 8 is a circuit diagram of an eighth embodiment of the present invention.

FIG. 8 is a circuit diagram of an eighth embodiment of the present invention. The circuit in FIG. 8 is applicable to a system using line inversion and back plane switching. The circuit in FIG. 8 includes a high voltage source Vhigh, a low voltage source Vlow, a high enable transistor 802, a low enable transistor 804, n capacitors C1 to Cn 806, n enabling transistors E1 to En 808, and a back plane node. The voltage of capacitor C1 is lower than Vhigh, the voltage of capacitor C2 is lower than the voltage of capacitor C1, the voltage of capacitor C3 is lower than the voltage of capacitor C2, and so on, until the voltage of capacitor Cn which is higher than Vlow.

When the voltage on the back plane node is to be switched from Vhigh to Vlow, a high enable signal is first de-asserted which turns off the high enable transistor 802 in order to disconnect the back plane node from Vhigh. Then transistor E1 is turned on to connect the back plane node to capacitor C1, so that the voltage of the back plane node is passively dropped to the voltage of capacitor C1. Then transistor E1 is turned off and transistor E2 is turned on. Then transistor E2 is turned off and transistor E3 is turned on. And so on, until finally, low enable transistor 804 is turned on, connecting the back plane node to Vlow. Similarly, but the opposite, when the voltage on the back plane is to be switched from Vlow to Vhigh. In this way, the majority of the voltage change may be done passively, and most of the charge for the switching is reused.

The above description is included to illustrate the operation of the preferred embodiments and is not meant to limit the scope of the invention. The scope of the invention is to be limited only by the following claims. From the above discussion, many variations will be apparent to one skilled in the art that would yet be encompassed by the spirit and scope of the invention.

What is claimed is:

1. A power-saving circuit for driving I even electrodes and J odd electrodes of an active matrix display, where I and J are positive integers, the circuit including:

I even voltage drivers, each said even voltage driver being coupled to a corresponding even electrode;

J odd voltage drivers, each said odd voltage driver being coupled to a corresponding odd electrode;

I even switches, each said even switch coupling the corresponding even electrode to a first reservoir line;

J odd switches, each said odd switch coupling the corresponding odd electrode to a second reservoir line;

an even coupling line for controlling the I even switches such that the I even switches electrically connect the I even electrodes to the first reservoir line when the even coupling line asserts an even coupling signal, and such that the I even switches electrically isolate the I even electrodes from the first reservoir line when the even coupling line de-asserts the even coupling signal;

an odd coupling line for controlling the J odd switches such that the J odd switches electrically connect the J odd electrodes to the second reservoir line when the odd coupling line asserts an odd coupling signal, and such that the J odd switches electrically isolate the J odd electrodes from the second reservoir line when the odd coupling line de-asserts the odd coupling signal; and a neutralizer switch coupling the I even electrodes to the J odd electrodes under control of a neutralizer signal such that the I even and the J odd electrodes are electrically connected together when the neutralizer signal is asserted, and such that the I even and the J odd electrodes are electrically isolated from each other when the neutralizer signal is de-asserted.

2. The circuit of claim 1, further including:

a positive storage element for storing charge at a positive voltage level relative to a midpoint voltage level;

a negative storage element for storing charge at a negative voltage level relative to the midpoint voltage level;

a matrix switch including a straight mode and a cross mode;

where the matrix switch in the straight mode electrically connects the first reservoir line to the positive storage element and the second reservoir line to the negative storage element; and where the matrix switch in the cross mode electrically connects the first reservoir line to the negative storage element and the second reservoir line to the positive storage element.

3. The circuit of claim 2, wherein the even and the odd coupling lines comprise a same line.

4. The circuit of claim 2, wherein the positive storage element comprises one side of a capacitor, and the negative storage element comprises another side of the capacitor.

5. The circuit of claim 1, further including:

a first positive storage element for storing charge at a first positive voltage level relative to a midpoint voltage level;

a second positive storage element for storing charge at a second positive voltage level relative to a midpoint voltage level, where the first positive voltage level is higher than the second positive voltage level;

a first negative storage element for storing charge at a first negative voltage level relative to the midpoint voltage level;

a second negative storage element for storing charge at a second negative voltage level relative to a midpoint voltage level, where the first negative voltage level is lower (more negative) than the second negative voltage level;

a matrix switch network including a straight mode and a cross mode;

where the matrix switch network in the straight mode initially electrically connects the first reservoir line to the first positive storage element and the second reservoir line to the first negative storage element, and subsequently electrically connects the first reservoir line to the second positive storage element the second reservoir line to the second negative storage element; and where the matrix switch network in the cross mode initially electrically connects the first reservoir line to the first negative storage element and the second reservoir line to the first positive storage element, and subsequently electrically connects the first reservoir line to the second negative storage element and the second reservoir line to the second positive storage element.

6. The circuit of claim 5, wherein the first positive storage element comprises a first capacitor, the second positive storage element comprises a second capacitor, the first negative storage element comprises a third capacitor, and the second negative storage element comprises a fourth capacitor.

7. The circuit of claim 5, wherein the first positive storage element comprises a first side of a first capacitor, the first negative storage element comprises a second side of the first capacitor, the second positive storage element comprises a first side of a second capacitor, and the second negative storage element comprises a second side of the second capacitor.

8. The circuit of claim 1, further including:

a first positive storage element for storing charge at a first positive voltage level relative to a midpoint voltage level;

a second positive storage element for storing charge at a second positive voltage level relative to the midpoint voltage level, where the second positive voltage level is lower than the first positive voltage level;

a third positive storage element for storing charge at a third positive voltage level relative to the midpoint voltage level, where the third positive voltage level is lower than the second positive voltage level;

a first negative storage element for storing charge at a first negative voltage level relative to the midpoint voltage level;

a second negative storage element for storing charge at a second negative voltage level relative to the midpoint voltage level, where the second negative voltage level is higher (less negative) than the first negative voltage level;

a third negative storage element for storing charge at a third negative voltage level relative to the midpoint voltage level, where the third negative voltage level is higher (less negative) than the second negative voltage level;

a matrix switch network including a straight mode and a cross mode;

where the matrix switch network in the straight mode initially electrically connects the first reservoir line to the first positive storage element and the second reservoir line to the first negative storage element, and subsequently electrically connects the first reservoir line to the second positive storage element and the second reservoir line to the second negative storage element, and finally electrically connects the first reservoir line to the third positive storage element and the second reservoir line to the third negative storage element; and where the matrix switch network in the cross mode initially electrically connects the first reservoir line to the first negative storage element and the second reservoir line to the first positive storage element, and subsequently electrically connects the first reservoir line to the second negative storage element and the second reservoir line to the second positive storage element, and finally electrically connects the first reservoir line to the third negative storage element and the second reservoir line to the third positive storage element.

9. A power-saving circuit for driving I even electrodes and J odd electrodes of an active matrix display, where I and J are positive integers, the circuit including:

I even voltage drivers, each said even voltage driver adapted to receive even pixel data and being coupled to a corresponding even electrode;

J odd voltage drivers, each said odd voltage driver adapted to receive odd pixel data and being coupled to a corresponding odd electrode;

I even switches, each said even switch coupling the corresponding even electrode to a first reservoir line;

J odd switches, each said odd switch coupling the corresponding odd electrode to a second reservoir line;

I even decision circuits adapted to receive the even pixel data for controlling on an individual basis the I even switches such that the I even electrodes may be connected on an individual basis to the even reservoir depending on the even pixel data;

J odd decision circuits adapted to receive the even pixel data for controlling on an individual basis the J odd switches such that the J odd electrodes may be connected on an individual basis to the odd reservoir depending on the odd pixel data;

a neutralizer switch coupling the first reservoir line to the second reservoir line under control of a neutralizer signal such that the even and second reservoir lines are electrically connected together when the neutralizer signal is asserted, and such that the even and second reservoir lines are electrically isolated from each other when the neutralizer signal is de-asserted;

a positive storage element for storing charge at a positive voltage level relative to a midpoint voltage level;

a negative storage element for storing charge at a negative voltage level relative to the midpoint voltage level;

a matrix switch including a straight mode and a cross mode;

where the matrix switch in the straight mode electrically connects the first reservoir line to the positive storage element and the second reservoir line to the negative storage element; and where the matrix switch in the cross mode electrically connects the first reservoir line to the negative storage element and the second reservoir line to the positive storage element.

10. The circuit of claim 9, wherein:

the I even decision circuits are further adapted to receive storage data relating to positive and negative storage elements, and the I even electrodes may be connected on an individual basis to the even reservoir depending on the even pixel data and the storage data; and the J odd decision circuits are further adapted to receive the storage data, and the J odd electrodes may be connected on an individual basis to the odd reservoir depending on the odd pixel data and the storage data.

11. A power-saving circuit for driving column electrodes of an active matrix display in a scheme involving row inversion and back plane switching, the circuit including:

a back plane node;

a high voltage source;

a high enable switch for electrically connecting the high voltage source to the back plane node when a high enable signal is asserted and for electrically isolating the high voltage source from the back plane node when a high enable signal is de-asserted;

a low voltage source;

a low enable switch for electrically connecting the low voltage source to the back plane node when a low enable signal is asserted and for electrically isolating the low voltage source from the back plane node when a low enable signal is de-asserted;

a first storage element;

a first storage switch for electrically connecting the first storage element to the back plane node when a first storage signal is asserted and for electrically isolating the first storage element from the back plane node when a first storage signal is de-asserted;

a second storage element; and a second storage switch for electrically connecting the second storage element to the back plane node when a second storage signal is asserted and for electrically isolating the second storage element from the back plane node when a second storage signal is de-asserted.

12. A power-saving circuit for driving N column electrodes of an active matrix display, where N is a positive integer, the circuit including:

N voltage drivers, each said voltage driver being coupled to a corresponding column electrode;

N−1 switches, each said switch coupling the corresponding column electrode to a next corresponding column electrode; and a neutralizer enable line for controlling the N−1 switches such that the N−1 switches electrically connect the N column electrodes when the neutralizer enable line asserts a signal, and such that the N−1 switches electrically isolate the N column electrodes when the neutralizer enable line de-asserts the signal.

13. The method of claim 12, wherein a capacitance of either the first storage device or the second storage device is greater than the capacitance of either the first or second set of electrodes.

14. A power-saving method for driving electrodes coupled to cells of an active matrix display, the method including:

driving a first set of the electrodes to a first positive voltage level relative to a midpoint voltage level and a second set of electrodes to a first negative voltage level relative to the midpoint voltage level;

electrically connecting the first set of electrodes to a first reservoir line and the second set of electrodes to a second reservoir line;

electrically connecting the first reservoir line to a first storage device and the second reservoir line to a second storage device;

electrically disconnecting the first reservoir line from the first storage device and the second reservoir line from the second storage device;

electrically connecting the first reservoir line to the second reservoir line;

electrically disconnecting the first reservoir line from the second reservoir line;

electrically connecting the first reservoir line to the second storage device and the second reservoir line to the first storage device;

electrically disconnecting the first reservoir line from the second storage device and the second reservoir line from the first storage device; and electrically disconnecting the first set of electrodes from the first reservoir line and the second set of electrodes from the second reservoir line.

15. The method of claim 14, further including:

driving a first set of the electrodes to a second negative voltage level relative to a midpoint voltage level and a second set of electrodes to a second positive voltage level relative to the midpoint voltage level;

electrically connecting the first set of electrodes to the first reservoir line and the second set of electrodes to the second reservoir line;

electrically connecting the first reservoir line to the second storage device and the second reservoir line to the first storage device;

electrically disconnecting the first reservoir line from the second storage device and the second reservoir line from the first storage device;

electrically connecting the first reservoir line to the second reservoir line;

electrically disconnecting the first reservoir line from the second reservoir line;

electrically connecting the first reservoir line to the first storage device and the second reservoir line to the second storage device;

electrically disconnecting the first reservoir line from the first storage device and the second reservoir line from the second storage device; and electrically disconnecting the first set of electrodes from the first reservoir line and the second set of electrodes from the second reservoir line.

16. The method of claim 15, wherein the first set of electrodes comprise even column electrodes, and the second set of electrodes comprise odd column electrodes.

17. The method of claim 16, wherein the first storage device holds charge at a positive voltage level relative to the midpoint voltage level, and the second storage device holds charge at a negative voltage level relative to the midpoint voltage level.

18. The method of claim 17, wherein the positive voltage level is roughly halfway in between the midpoint voltage level and a highest (most positive) voltage level driven onto the electrodes during operation of the display, and the negative voltage level is roughly halfway in between the midpoint voltage level and a lowest (most negative) voltage level driven onto the electrodes during operation of the display.

19. The method of claim 15, where on average more than half of the power needed by the electrodes is passively provided by the first and second storage device, and on average less than half of the power needed by the electrodes is actively provided by voltage driving circuitry.

20. The method of claim 15, wherein each of the first and second storage devices comprises a plurality of individually selectable capacitors.

* * * * *